US011284194B2

(12) United States Patent
Marti et al.

(10) Patent No.: US 11,284,194 B2
(45) Date of Patent: Mar. 22, 2022

(54) TECHNIQUES FOR GENERATING SPATIAL SOUND VIA HEAD-MOUNTED EXTERNAL FACING SPEAKERS

(71) Applicant: HARMAN INTERNATIONAL INDUSTRIES, INCORPORATED, Stamford, CT (US)

(72) Inventors: Stefan Marti, Oakland, CA (US); Joseph Verbeke, San Francisco, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/921,835

(22) Filed: Jul. 6, 2020

(65) Prior Publication Data

US 2022/0007112 A1 Jan. 6, 2022

(51) Int. Cl.

| | |
|---|---|
| ***H04R 5/04*** | (2006.01) |
| ***H04R 5/033*** | (2006.01) |
| ***H04S 7/00*** | (2006.01) |
| ***H04R 1/10*** | (2006.01) |
| ***H04R 1/40*** | (2006.01) |

(52) U.S. Cl.

CPC ..... *H04R 5/04* (2013.01); *H04R 1/1008* (2013.01); *H04R 1/40* (2013.01); *H04R 5/033* (2013.01); *H04S 7/304* (2013.01)

(58) Field of Classification Search

None

See application file for complete search history.

(56) References Cited

U.S. PATENT DOCUMENTS

| | | | | |
|---|---|---|---|---|
| 9,060,221 | B1 | 6/2015 | Kaplan | |
| 9,191,733 | B2 | 11/2015 | Yamada et al. | |
| 10,257,637 | B2 | 4/2019 | Di Censo et al. | |
| 10,299,064 | B2 | 5/2019 | Di Censo et al. | |
| 10,838,690 | B2 | 11/2020 | Nahman et al. | |
| 2008/0310658 | A1* | 12/2008 | Kuo | H04R 1/1075 381/310 |
| 2015/0092965 | A1* | 4/2015 | Umminger | H04S 7/304 381/310 |
| 2015/0245159 | A1* | 8/2015 | Osman | H04S 7/304 381/303 |
| 2015/0379842 | A1 | 12/2015 | Di Censo et al. | |
| 2018/0295461 | A1* | 10/2018 | Di Censo | H04S 3/008 |
| 2019/0227766 | A1 | 7/2019 | Nahman et al. | |
| 2020/0029151 | A1* | 1/2020 | Cole | H04R 1/1008 |
| 2020/0282261 | A1* | 9/2020 | Patil | A63B 24/0003 |

FOREIGN PATENT DOCUMENTS

JP 2010-258653 A 11/2010

* cited by examiner

*Primary Examiner* — Paul W Huber
(74) *Attorney, Agent, or Firm* — Artegis Law Group, LLP

(57) ABSTRACT

One or more embodiments include techniques for generating audio for a speaker system worn by a listener. The speaker system analyzes an audio input signal to determine that a sound component of the audio input signal has an apparent location that is at a vertical distance from a listener. The speaker system selects an externally facing speaker included in the speaker system that faces at least partially upward or at least partially downward based on the vertical distance from the listener. The speaker system transmits the sound component to the externally facing speaker.

20 Claims, 8 Drawing Sheets

TECHNIQUES FOR GENERATING SPATIAL SOUND VIA HEAD-MOUNTED EXTERNAL FACING SPEAKERS

BACKGROUND

Field of the Embodiments of the Present Disclosure

Embodiments of the present disclosure relate generally to audio processing systems and, more specifically, to techniques for generating spatial sound via head-mounted external facing speakers.

Description of the Related Art

Entertainment systems, such as audio/video systems implemented in movie theaters, advanced home theaters, music venues, and/or the like, continue to provide increasingly immersive experiences that include high-resolution video and multi-channel audio soundtracks. For example, commercial movie theater systems commonly enable multiple, distinct audio channels that are transmitted to separate speakers placed in front of, behind, and to the sides of the listeners. Such audio/video systems may also include audio channels that are transmitted to separate speakers placed above and below the listeners. As a result, listeners experience a full three-dimensional (3D) sound field that surrounds the listeners on all sides.

Listeners also desire to experience immersive 3D sounds fields when listening to audio via headphones or wearing a headset designed to generate audio/video augmented reality (AR) and/or virtual reality (VR) environments. Such headphones and headsets are collectively referred to herein as "head-mounted speaker systems." Typically, such head-mounted speaker systems include one or more first speakers that are placed near the listener's left ear and one or more second speakers that are placed near the listener's right ear, thereby generating stereophonic audio for the listener. More advanced head-mounted speaker systems implement generic and/or listener-specific head-related transfer functions (HRTFs) that reproduce sounds that a listener interprets as being located at specific locations in a two-dimensional (2D) plane that includes the listeners ears. HRTF and other similar technologies thereby provide a more immersive listening experience relative to stereophonic head-mounted speaker systems.

One potential drawback to the techniques described above is that HRTF and similar technologies are generally unable to reproduce sounds that a listener would interpret as being located above the listener, such as an aircraft flying overhead, or below the listener, such as a barking dog or a meowing cat. Instead, all sounds appear to be in the same plane of the ears of the listener. As a result, the audio experience of a listener using a head-mounted speaker system is less immersive relative to commercial movie theater systems and advanced home theater systems.

As the foregoing illustrates, improved techniques for generating audio for head-mounted speaker systems would be useful.

SUMMARY

Various embodiments of the present disclosure set forth a computer-implemented method for generating audio for a speaker system worn by a listener. The method includes analyzing an audio input signal to determine that a sound component of the audio input signal has an apparent location that is at a vertical distance from a listener. The method further includes selecting an externally facing speaker included in the speaker system that faces at least partially upward or at least partially downward based on the vertical distance from the listener. The method further includes transmitting the sound component to the externally facing speaker.

Other embodiments include, without limitation, a system that implements one or more aspects of the disclosed techniques, and one or more computer readable media including instructions for performing one or more aspects of the disclosed techniques.

At least one technical advantage of the disclosed techniques relative to the prior art is that sound from the left and right speakers of a head-mounted speaker system is augmented by sound that is reflected off a surface above the listener, giving the listener the impression that the sound is located above the listener. Sound from the left and right speakers of a head-mounted speaker system is further augmented by sound that is reflected off a surface below the listener, giving the listener the impression that the sound is located below the listener. As a result, the head-mounted speaker system generates a more immersive sound field relative to prior approaches. These technical advantages represent one or more technological improvements over prior art approaches.

BRIEF DESCRIPTION OF THE SEVERAL VIEWS OF THE DRAWINGS

So that the manner in which the recited features of the one more embodiments set forth above can be understood in detail, a more particular description of the one or more embodiments, briefly summarized above, may be had by reference to certain specific embodiments, some of which are illustrated in the appended drawings. It is to be noted, however, that the appended drawings illustrate only typical embodiments and are therefore not to be considered limiting of its scope in any manner, for the scope of the disclosure subsumes other embodiments as well.

DETAILED DESCRIPTION

In the following description, numerous specific details are set forth to provide a more thorough understanding of certain specific embodiments. However, it will be apparent to one of skill in the art that other embodiments may be practiced without one or more of these specific details or with additional specific details.

Figure 1B:
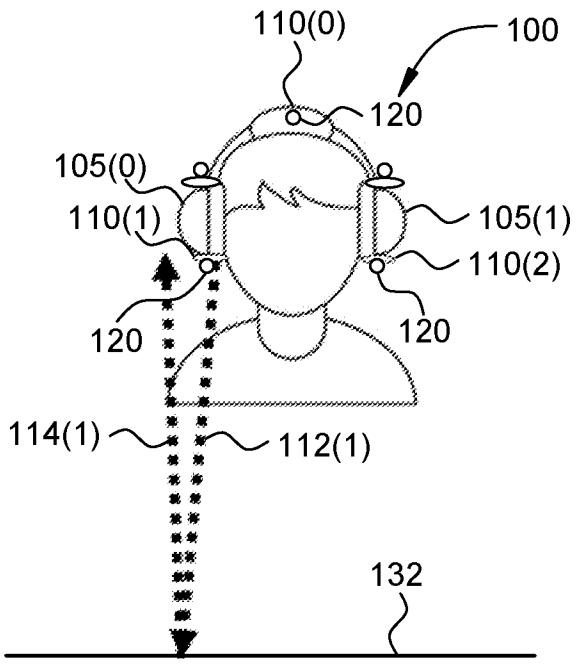
FIGS. 1A-1C illustrate a head-mounted speaker system that generates audio signals for vertically directed speakers, according to various embodiments.
Figure 1A:
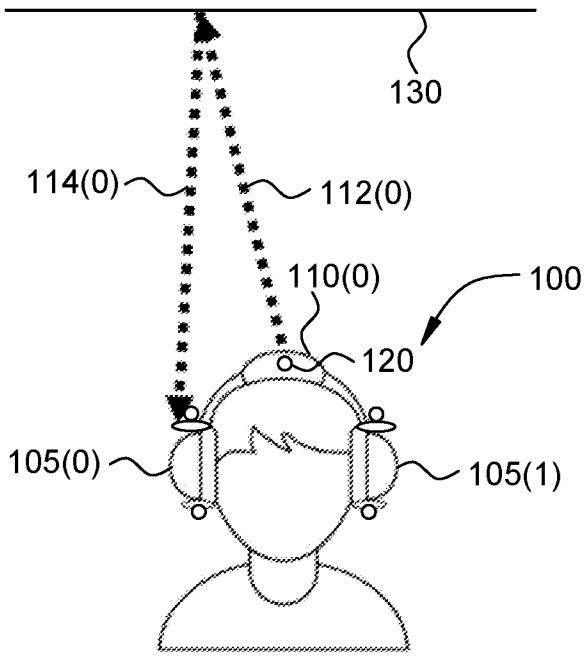
Figure 1C:
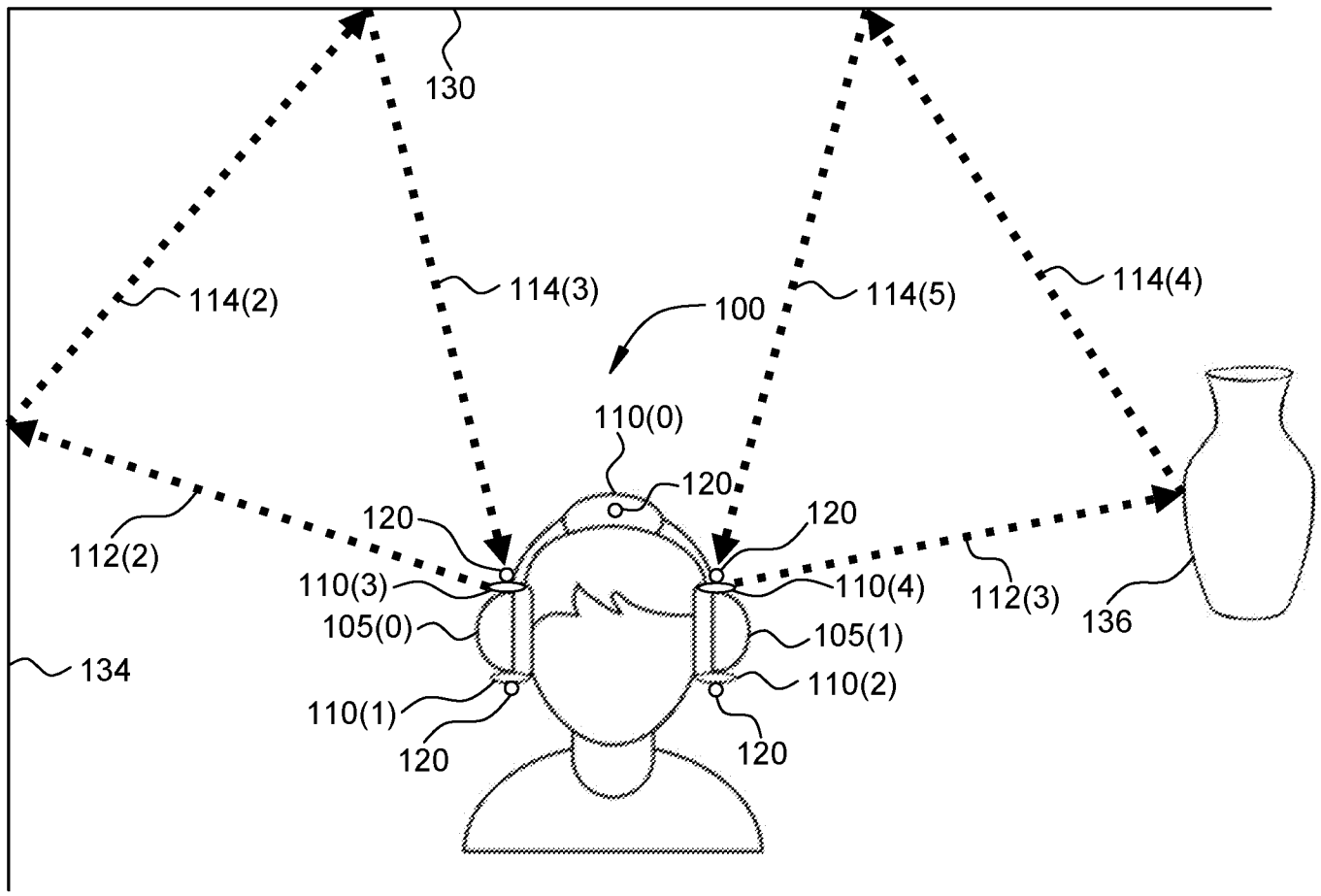

FIGS. 1A-1C illustrate a head-mounted speaker system 100 that generates audio signals for vertically directed speakers, according to various embodiments. As shown, the head-mounted speaker system 100 includes one or more speakers 105 mounted near the ears of a listener and one or more highly directional speakers 110 positioned to project audio signals upward or downward. The head-mounted speaker system 100 further includes a computing device (not shown) that may be coupled to and/or integrated with the speakers 105 and the highly directional speakers 110. A processing unit included in the computing device receives an audio input signal and transmits portions of the audio input signal to various speakers 105 and highly directional speakers 110. The processing unit transmits portions of the audio input signal to speaker 105(0) and speaker 105(1) to direct audio into the right ear and the left ear of the listener, respectively. In some embodiments, head-mounted speaker system 100 includes an open speaker enclosure, also referred in herein as an "open-back" speaker enclosure, such that the listener hears direct sound from speakers 105 as well as sounds from the environment, such as sound waves transmitted by highly directional speakers 110 that reflect off of one or more surfaces within the environment. In some embodiments, the head-mounted speaker system 100 may include a closed speaker enclosure, also referred in herein as an "closed-back" speaker enclosure, such that the listener primarily hears direct sound from speakers 105 and hears little to no sound from the environment. In these latter embodiments, the head-mounted speaker system 100 may acquire sound data from the environment via one or more microphones and transmit the sound data to speakers 105(0) and 105(1) such that the sound is heard by the right ear and the left ear of the listener, respectively. The head-mounted speaker system 100 may be in any technically feasible configuration, including headphones, AR/VR headsets, ear buds, bone conduction devices, helmet mounted speaker systems, and/or the like. In general, any device configured to generate personalized sound via audio signals, including sounds from the environment, directed to the ears of a particular listener is within the scope of the present disclosure. In that regard, the techniques disclosed herein apply to any speaker system worn by a listener. Such a speaker system may include a head-mounted speaker system, such as head-mounted speaker system 100, a shoulder-mounted speaker system, a speaker system embedded in an article of clothing, a speaker system worn around the neck, and/or the like.

As shown in FIG. 1A, if the audio input signal includes one or more sound components located above the listener, then the processing unit of the head-mounted speaker system 100 directs the sound components towards an upward facing highly directional speaker, such as highly directional speaker 110(0). The highly directional speaker 110(0) transmits sound waves 112(0) towards a surface 130, such as a ceiling. The position and/or orientation of the surface 130 may be detected via one or more sensors, such as sensor 120 associated with highly directional speaker 110(0). In various embodiments, sensor 120 may be mounted on some portion of highly directional speaker 110(0), on any portion of head-mounted speaker system 100, on an item of clothing, and/or the like. A portion of the sound waves 112(0) reflects off the surface 130 to generate reflected sound waves 114(0) that the listener perceives as emanating from above the listener. Additionally, speakers 105(0) and 105(1) direct sound waves towards the right ear and the left ear of the listener, respectively. Similarly, as shown in FIG. 1B, if the audio input signal includes one or more sound components located below the listener, then the processing unit of the head-mounted speaker system 100 directs the sound components towards a downward facing highly directional speaker, such as highly directional speaker 110(1) and/or highly directional speaker 110(2). The highly directional speakers 110(1) and 110(2) transmit sound waves 112(1) towards a surface 132, such as a floor or the ground. The position and/or orientation of the surface 132 may be detected via one or more sensors, such as sensors 120 associated with highly directional speakers 110(0), 110(1), and 110(2). In various embodiments, sensors 120 may be mounted on some portion of highly directional speakers 110(0), 110(1), and 110(2), on any portion of head-mounted speaker system 100, on an item of clothing, and/or the like. A portion of the sound waves 112(1) reflects off the surface 132 to generate reflected sound waves 114(1) that the listener perceives as emanating from below the listener. Additionally, speakers 105(0) and 105(1) direct sound waves towards the right ear and the left ear of the listener, respectively.

As shown in FIG. 1C, the highly directional speakers 110 may transmit sound waves towards a location on a first surface, where the sound waves reflect off of the first surface and one or more additional surfaces before reaching the ears of the listener. For example, the audio input signal may include one or more sound components located above the listener. The processing unit of the head-mounted speaker system 100 directs the sound components towards one or more upward facing highly directional speakers, such as highly directional speakers 110(3) and/or 110(4). Highly directional speaker 110(3) transmits sound waves 112(2) towards a surface 134, such as a wall. A portion of the sound waves 112(2) reflects off the surface 134 to generate reflected sound waves 114(2). The reflected sound waves 114(2) are directed towards a surface 130, such as a ceiling. A portion of the reflected sound waves 114(2) reflects off the surface 130 to generate reflected sound waves 114(3) that the listener perceives as emanating from above and to the right of the listener.

Similarly, highly directional speaker 110(4) transmits sound waves 112(3) towards a surface 136, such as a vase or other object in the environment. A portion of the sound waves 112(3) reflects off the surface 136 to generate reflected sound waves 114(4). The reflected sound waves 114(4) are directed towards a surface 130, such as a ceiling. A portion of the reflected sound waves 114(4) reflects off the surface 130 to generate reflected sound waves 114(5) that the listener perceives as emanating from above and to the left of the listener. The positions and/or orientations of the surfaces 130, 134, and 136 may be detected via one or more sensors, such as sensors 120 associated with highly directional speakers 110(0)-110(4). In various embodiments, sensors 120 may be mounted on some portion of highly directional speakers 110(0)-110(4), on any portion of head-mounted speaker system 100, on an item of clothing, and/or the like. Additionally, speakers 105(0) and 105(1) direct sound waves towards the right ear and the left ear of the listener, respectively.

In some embodiments, the highly directional speakers 110 are disposed on the headband, the earcups, and/or any other technically feasible portion of the head-mounted speaker system 100. Each of the highly directional speakers 110 disposed on the headband, the earcups, and/or other portion of the head-mounted speaker system 100 may be upward facing or downward facing. For example, and without limitation, highly directional speaker 110(0) is upward facing and mounted on the headband of the head-mounted speaker system 100. Highly directional speakers 110(1) and 110(2) are downward facing and mounted on the lower portions of the earcups of the head-mounted speaker system 100. Highly directional speakers 110(3) and 110(4) are upward facing and mounted on the upper portions of the earcups of the head-mounted speaker system 100. In some embodiments, the highly directional speakers 110 may be coupled to an item of clothing (e.g., a jacket, sweater, shirt, etc.) or harness being worn by the listener, built into an item of clothing (e.g., built into shoulder pads of an item of clothing), or integrated in jewelry (e.g., a necklace).

In various embodiments, the processing unit of the head-mounted speaker system 100 tracks the positions and/or orientations of various surfaces in the environment. For example, if the environment is an interior area, such as a room, the processing unit tracks positions and/or orientations of the surfaces of ceilings, floors, walls, and/or other solid objects within the interior area via the sensors 120. If the environment is an exterior area, the processing unit tracks positions and/or orientations of the surfaces of the ground, sidewalks, walls and overhangs of buildings, and/or other solid objects within the exterior area via the sensors 120. The processing unit determines an orientation in which a highly directional speaker 110 should be positioned in order to cause sound waves 112 representing the sound components to be transmitted towards a particular location on a surface and reflected back as sound waves 114 towards the listener. For example, and without limitation, the sensors 120 may track the location of the surfaces of various objects in an interior or exterior environment by performing SLAM (simultaneous localization and mapping). The sensors 120 transmit the positions and/or orientations of the surfaces to the processing unit. Additionally or alternatively, the sensors transmit data representative of a depth map of the interior or exterior environment.

The sensors 120 further transmit the audio reflectivity of various locations on the surfaces to the processing unit. Hard surfaces, such as stone, concrete, or metal may have a high reflectivity, indicating that a relatively large portion of the audio is reflected off the surface. Soft surfaces, such as carpet, drapes, or grass may have a low reflectivity, indicating that a relatively large portion of the audio is absorbed by the surface, while a relatively small portion of the audio is reflected off the surface. In some embodiments, the sensors 120 are mounted on the highly directional speakers 110. Additionally or alternatively, the sensors 120 may be mounted on any technically feasible portion of the head-mounted speaker system 100. More particularly, the sensors may be mounted on the headband, the upper portion of the earcups, the lower portion of the earcups, or on any other portion of the head-mounted speaker system 100. In some embodiments, the sensors 120 may be coupled to an item of clothing (e.g., a jacket, sweater, shirt, etc.) or harness being worn by the listener, built into an item of clothing (e.g., built into shoulder pads of an item of clothing), or integrated in jewelry (e.g., a necklace).

The head-mounted speaker system 100 then uses the positions, orientations, and/or reflectivity of the surfaces to determine a speaker orientation that will enable the corresponding highly directional speaker 110 to transmit a sound component included in the audio input signal directly to a surface such that the sound waves 112 representing the sound component reflects off the surface and is then directed back as sound waves 114 towards the listener. In some embodiments, the speaker orientation is determined by computing a vector (e.g., a three-dimensional vector) from a location of a highly directional speaker 110 (e.g., a driver included in a highly directional speaker 110) to the location of a surface. In some embodiments, the head-mounted speaker system 100 selects a surface based on reflectivity values. For example, the head-mounted speaker system 100 may determine that the sound component could either be directed towards a first location on a first surface or towards a second location on a second surface in order to reflect off of the respective surface back towards the listener. The head-mounted speaker system 100 may determine a first reflectivity of the first surface and a second reflectivity of the second surface. The head-mounted speaker system 100 selects either the first location on the first surface or the second location on the second surface based on the first reflectivity and the second reflectivity. The head-mounted speaker system 100 then configures a highly directional speaker to direct sound waves towards the selected location on the selected surface based on the first reflectivity and the second reflectivity.

In some embodiments, the processing unit of the head-mounted speaker system 100 measures the acoustic round-trip delays between when sound waves are transmitted by each highly directional speaker 110 and when the sound waves, after reflecting off one or more surfaces in the environment, return to the ears of the listener. Additionally or alternatively, the processing unit measures the acoustic delays based on the vertical distance between each detected surface in the environment and the listener. Based on these delays, the processing unit of the head-mounted speaker system 100 may delay the audio signal transmitted to speakers 105 to account for the acoustic delays of the sound waves transmitted by the highly directional speakers 110. As a result, the timing of the sound waves transmitted by the highly directional speakers 110 and the sound waves transmitted by the speakers 105 are synchronized, as perceived by the listener. As further described herein, the highly directional speakers 110 may transmit sound waves towards a location on a first surface, where the sound waves reflect off of the first surface and one or more additional surfaces before reaching the ears of the listener. In such embodiments, the processing unit measures the delays based on all relevant reflections of the sound waves between transmission of the sound waves by the highly directional speakers 110 and the arrival of the sound waves at the ears of the listener.

Upward facing highly directional speakers 110(0), 110(3), and 110(4) may be configured to emit upward-directed sound waves 112 having very low beam divergence, such that a narrow cone of sound may be transmitted in a specific direction (e.g., towards a portion of a surface that is above the listener). Similarly, downward facing highly directional speakers 110(1) and 110(2) may be configured to emit downward-directed sound waves 112 having very low beam divergence, such that a narrow cone of sound may be transmitted in a specific direction (e.g., towards a portion of a surface that is below the listener). In some embodiments, the sound waves 112, after reflecting off a surface in the environment, scatter in different directions, thereby generating reflected sound waves 114 having a wider cone of sound than the narrow cone of sound transmitted by the highly directional speakers 110. In some embodiments, the sound waves 112, after reflecting off a surface in the environment, may experience little to no scatter, thereby generating reflected sound waves 114 having a cone of sound that is more or less the same as the narrow cone of sound transmitted by the highly directional speakers 110. In general, the listener is more likely to hear reflected sound waves 114 in a wider cone of sound resulting from scatter than reflected sound waves 114 in a narrower cone of sound resulting from little to no scatter.

In some embodiments, the head-mounted speaker system 100 receives a stereophonic audio input signal that includes a left audio channel and a right audio channel. In such embodiments, the processing unit analyzes the two channels of the stereophonic audio input signal to determine which portion of the audio input signal is to be extracted as separate sound components and transmitted to one or more highly directional speakers 110. Furthermore, the processing unit determines the positions and/or orientations of one or more locations on surfaces to which sound waves representing the sound components are to be directed.

In some embodiments, the head-mounted speaker system 100 receives a multi-channel audio input signal that includes multiple audio channels, such as a 5.1 audio input signal, a 7.2 audio input signal, and/or the like. In such embodiments, the processing unit analyzes each of the channels of the multi-channel audio input signal to determine which portion of the audio input signal is to be extracted as separate sound components and transmitted to one or more highly directional speakers 110. Furthermore, the processing unit determines the positions and/or orientations of one or more locations on surfaces to which sound waves representing the sound components are to be directed. In this manner, the head-mounted speaker system 100 utilizes the spatial separation of the multiple channels, including the surround channels, to better localize specific sound components.

In some embodiments, the head-mounted speaker system 100 receives an audio input signal that includes separate sound objects, corresponding to sound components located at specific 3D locations in an AR environment and/or a VR environment. An AR environment and/or a VR environment is more generally referred to herein as an extended reality (XR) environment. In some embodiments, the XR environment may be associated with a gaming environment. The listener may experience and interact with the gaming environment via a mobile gaming console, headphones, an AR/VR headset, and/or the like. The audio input signal includes metadata that specifies the 3D locations of each sound component. For each sound component, the processing unit compares the 3D location of the sound component with the current location of the listener. If any one or more of the sound objects is located above or below the listener, then the processing unit determines the positions and/or orientations of one or more locations on surfaces to which sound waves representing the sound components of the sound objects are to be directed. In this manner, the head-mounted speaker system 100 utilizes the actual locations of AR and/or VR sound objects to better localize specific sound components.

In some embodiments, the head-mounted speaker system 100 employs object recognition on the audio input signal to detect sound components associated with various objects. The head-mounted speaker system 100 determines a typical location for the detected sound components. In some embodiments, the head-mounted speaker system 100 may associate the sound components with a type of object, such as a flying helicopter, a flying airplane, a taxiing airplane, a screeching eagle, a flowing river, an earthquake, and/or the like. The head-mounted speaker system 100 may use the type of object as a key to find the type of object in a database entry included in the database. The head-mounted speaker system 100 determines, from the database entry, a location corresponding to the type of object. Based on the location, the head-mounted speaker system 100 may direct the sound component to one or more upward facing highly directional speakers 110 and/or one or more downward facing highly directional speakers 110.

In one example, the head-mounted speaker system 100 may determine that the audio input signal includes a sound component representing a flowing river or an earthquake. The head-mounted speaker system 100 may determine that the location corresponding to a flowing river or an earthquake is below the listener. As a result, the head-mounted speaker system 100 may direct the sound component to one or more downward facing highly directional speakers 110. In another example, the head-mounted speaker system 100 may determine that the audio input signal includes a sound component representing a flying helicopter, a flying airplane, or a screeching eagle located at some distance from the listener. The head-mounted speaker system 100 may determine that the location corresponding to a flying helicopter, a flying airplane, or a screeching eagle is above the listener. As a result, the head-mounted speaker system 100 may direct the sound component to one or more upward facing highly directional speakers 110. In yet another example, the head-mounted speaker system 100 may determine that the audio input signal includes a sound component representing an airplane taxiing on a tarmac. The head-mounted speaker system 100 may determine that the location corresponding to a taxiing airplane is at the level of the listener. As a result, the head-mounted speaker system 100 may elect to not direct the sound component to any downward facing highly directional speakers 110 or any upward facing highly directional speakers 110.

In some embodiments, the head-mounted speaker system 100 may be integrated into a helmet worn by the listener. In such embodiments, the head-mounted speaker system 100 may generate additional sound components to augment the audio experience of the listener. For example, a helmet worn by a construction worker may transmit a sound component to one or more highly directional speakers 110 to alert other people in proximity of the listener when the listener is under high cognitive load. Additionally or alternatively, a helmet worn by a skateboarder or snowboarder worker may transmit a sound component to one or more highly directional speakers 110 to alert other people in proximity of the listener when the listener is approaching.

In some embodiments, the highly directional speaker 110 generates a modulated sound wave 112 that includes two ultrasound waves. One ultrasound wave serves as a reference tone (e.g., a constant 200 kHz carrier wave), while the other ultrasound wave serves as a signal, which may be modulated between about 200, 200 Hz and about 220,000 Hz. Once the modulated sound wave 112 strikes an object (e.g., a listener's head), the ultrasound waves slow down and mix together, generating both constructive interfere and destructive interference. The result of the interference between the ultrasound waves is a third sound wave having a lower frequency, typically in the range of about 200 Hz to about 20,000 Hz. In some embodiments, an electronic circuit attached to piezoelectric transducers constantly alters the frequency of the ultrasound waves (e.g., by modulating one of the waves between about 200, 200 Hz and about 220,000 Hz) in order to generate the correct, lower-frequency sound waves when the modulated sound wave 112 strikes an object. The process by which the two ultrasound waves are mixed together is commonly referred to as "parametric interaction."

In various embodiments, one or more of the sensors 120 may dynamically track head movements of the listener (e.g., the positions and/or orientations of the ears and/or head of the listener) in order to generate a consistent and realistic audio experience, even when the listener tilts or turns his or her head. For example, and without limitation, the sensors 120 may identify changes in the positions and/or orientations of the surfaces relative to the head-mounted speaker system 100 (e.g., relative to a highly directional speaker 110). The updated positions and/or orientations of the surfaces may then be used to determine an orientation in which the highly directional speaker 110 should be positioned.

The sensors 120 may implement any sensing technique that is capable of tracking the surfaces within the environment. In some embodiments, the sensors 120 include a visual sensor, such as a camera (e.g., a stereoscopic camera). In such embodiments, the sensors 120 may be further configured to perform object recognition in order to determine the position and/or orientation of surfaces. Additionally or alternatively, the sensors 120 may include ultrasonic sensors, radar sensors, laser sensors, light detection and ranging (LIDAR) sensors, thermal sensors, and/or depth sensors, such as time-of-flight (TOF) sensors, structured light sensors, and/or the like.

Figure 2A:
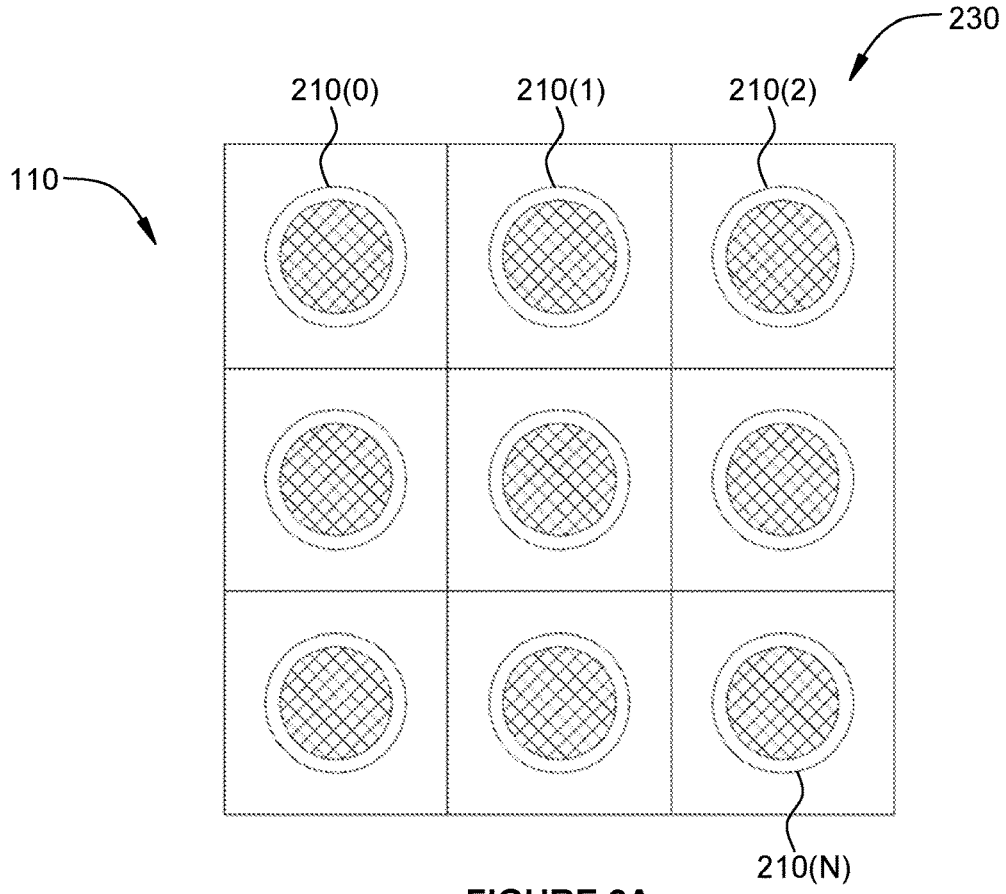
FIGS. 2A and 2B illustrate highly directional speakers that may be implemented in conjunction with the head-mounted speaker system of FIG. 1, according to various embodiments.
Figure 2B:
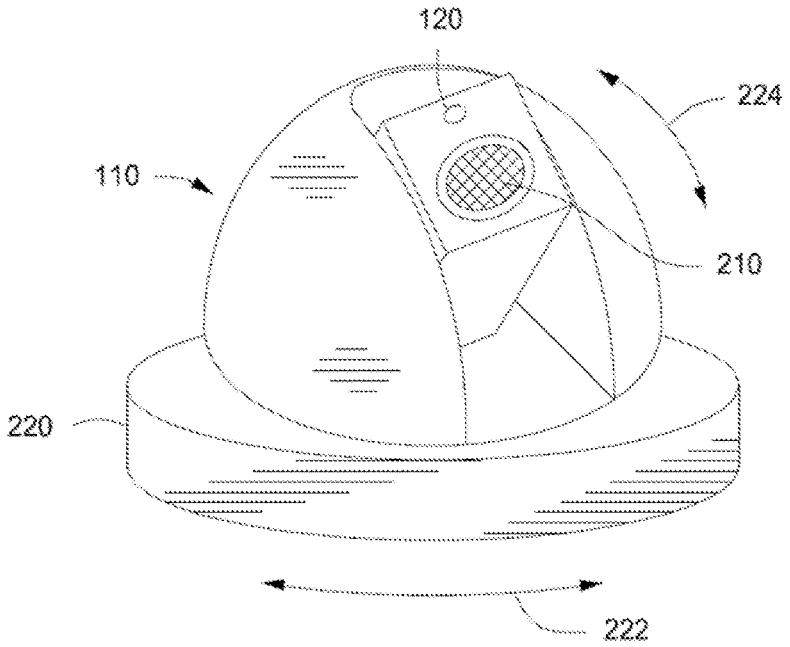

FIGS. 2A and 2B illustrate highly directional speakers 110 that may be implemented in conjunction with the head-mounted speaker system 100 of FIG. 1, according to various embodiments. In some embodiments, the highly directional speaker 110 includes multiple drivers 210 arranged in an array, grid, pattern, etc., as shown in FIG. 2A. In such embodiments, some or all of the drivers 210 may have different static orientations. Then, during operation of the head-mounted speaker system 100, one of more of the drivers 210 may be selected based on the position and/or orientation of a surface relative to the head of the listener. For example, and without limitation, when a surface is in a first position and/or orientation relative to the head of the listener, a first driver 210 included in an array and having a first orientation directed at the first position may be selected to transmit the sound waves 112 associated with a sound component. Then, when the head of the listener moves such that the surface is in a second position and/or orientation relative to the head of the listener, a second driver 210 included in the array and having a second orientation directed at the second position may be selected to transmit the sound waves 112 associated with a sound component. In some embodiments, one or more of the drivers 210 included in the array may be configured to orient the one or more drivers 210, such as by panning and/or tilting the one or more drivers 210, to direct sound waves towards a location on a surface.

Additionally or alternatively, static drivers 210 and/or movable drivers 210 may be implemented in conjunction with digital signal processing (DSP) techniques that enable the sound waves 112 to be steered in specific directions (e.g., via beam-forming and/or generating constructive/destructive interference between sound waves 112 produced by the drivers 210) relative to the array of drivers 210. That is, the dominant direction of the sound waves 112 may be controlled to be directed towards a particular location on a surface relative to the head of the listener. Such embodiments enable sound components to be transmitted in different directions (e.g., according to different speaker orientations determined based on a dynamic relative position and/or orientation of a surface to the head of the listener) without requiring moving parts. Additionally, such DSP techniques may be faster and more responsive than mechanically reorienting the drivers 210 each time the position and/or orientation on the surface of changes relative to the head of the listener.

As shown in FIG. 2B, the highly directional speaker 110 may include one or more drivers 210 coupled to a pan-tilt assembly 220. In some embodiments, the pan-tilt assembly 220 is a low-profile assembly that can be integrated into the head-mounted speaker system 100. In some embodiments, the pan-tilt assembly 220 may be integrated into an article of clothing, a harness worn by the listener, and/or the like. The highly directional speaker 110 may also include one or more sensors 120.

The pan-tilt assembly 220 is operable to orient the driver 210, such as by panning and/or tilting the driver 210, towards a particular location on a surface relative to the head of the listener which a sound component is to be transmitted. Sound waves 112 (e.g., ultrasound carrier waves and audible sound waves associated with a sound component) are then generated by the driver 210 and transmitted towards the particular location on a surface relative to the head of the listener, causing the sound waves representing the sound component to be reflected off the surface and then directed back towards the listener. Accordingly, the head-mounted speaker system 100 is able to track the position and/or orientation of the location on a surface relative to the head of the listener and transmit sound components to the same location. One type of driver 210 that may be implemented in the highly directional speakers 110 in various embodiments is a hypersonic sound speaker (HSS) driver. However, any other type of driver or loudspeaker that is capable of generating sound waves 112 having very low beam divergence may be implemented with the various embodiments disclosed herein.

The pan-tilt assembly 220 may include one or more robotically controlled actuators that are capable of panning 222 and/or tilting 224 the driver 210 relative to a base in order to orient the driver 210 towards a location on a surface relative to the head of the listener. In some embodiments, a single assembly may be used for pointing the highly directional speaker 110 upwards and/or downwards. In this manner, a single highly directional speaker 110 may be employed for reflecting sound off of a surface above the listener, such as a ceiling, and for reflecting sound off of a surface below the listener, such as a floor. Such a highly directional speaker 110 may be mounted on the side of the earcups of head-mounted speaker system 100. As a result, highly directional speaker 110 may be oriented to point upwards and/or downwards. The pan-tilt assembly 220 may be similar to assemblies used in surveillance systems, video production equipment, and/or the like and may include various mechanical parts (e.g., shafts, gears, and/or ball bearings), and actuators that drive the assembly. Such actuators may include electric motors, piezoelectric motors, hydraulic and pneumatic actuators, and/or any other type of actuator. The actuators may be substantially silent during operation and/or an active noise cancellation technique (e.g., noise cancellation signals generated by the highly directional speaker 110) may be used to reduce the noise generated by movement of the actuators and pan-tilt assembly 220. In some embodiments, the pan-tilt assembly 220 is capable of turning and rotating in any desired direction, both vertically and horizontally. Accordingly, the driver(s) 210 coupled to the pan-tilt assembly 220 may be pointed in any desired direction to match changes to the location on the surface relative to the head of the listener. In some embodiments, the assembly to which the driver(s) 210 are coupled is capable of only panning 222 or tilting 224, such that the orientation of the driver(s) 210 can be changed in either a vertical or a horizontal direction.

In some embodiments, one or more sensors 120 are mounted separately from the highly directional speaker(s) 110. For example, and without limitation, one or more sensors 120 may be mounted separately in an article of clothing being worn by the listener and/or in an electronic device (e.g., a mobile device) being carried by the listener.

Figure 3:
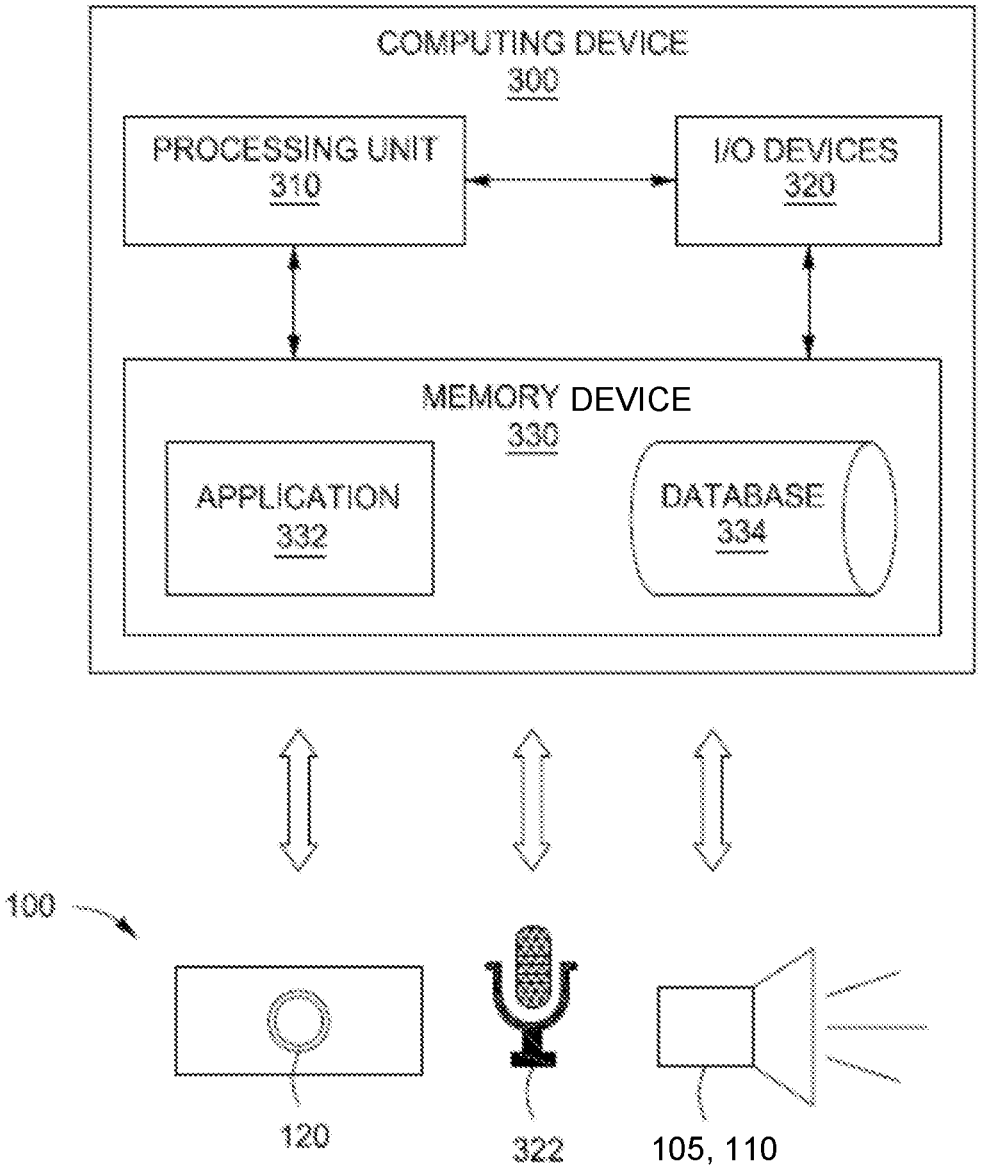
FIG. 3 is a block diagram of a computing device that may be implemented in conjunction with or coupled to the head-mounted speaker system of FIG. 1, according to various embodiments.

FIG. 3 is a block diagram of a computing device 300 that may be implemented in conjunction with or coupled to the head-mounted speaker system 100 of FIG. 1, according to various embodiments. As shown, computing device 300 includes a processing unit 310, input/output (I/O) devices 320, and a memory device 330. Memory device 330 includes an application 332 configured to interact with a database 334. The computing device 300 is coupled to one or more highly directional speakers 110 and one or more sensors 120.

Processing unit 310 may include one or more central processing units (CPUs), one or more digital signal processing unit (DSPs), and/or the like. In various embodiments, the processing unit 310 is configured to analyze data acquired by the sensor(s) 120 to determine positions, orientations, and/or reflectivity of the surfaces within the environment of the listener. The positions, orientations, and/or reflectivity of the surfaces within the environment may be stored in the database 334. The processing unit 310 is further configured to compute a vector from a location of a highly directional speaker 110 to a particular location on a surface within the environment based on the position, and/or orientation of the listener. For example, and without limitation, the processing unit 310 may receive data from the sensors 120 and process the data to dynamically track the movements of the head of the listener. Then, based on changes to the position and/or orientation of the head of the listener, the processing unit 310 may compute one or more vectors that cause a sound component generated by a highly directional speaker 110 to be transmitted directly towards a particular location on a surface within the environment. The processing unit 310 then determines, based on the one or more vectors, an orientation in which the driver(s) 210 of the highly directional speaker 110 should be positioned to transmit the sound component towards the particular location on the surface. Accordingly, the processing unit 310 may communicate with and control the DSP module included in an array of drivers 210 and/or the pan-tilt assembly 220.

In some embodiments, the processing unit 310 may further acquire sound data via a microphone 322 and generate one or more cancellation signals to cancel ambient noise in the environment of the listener. The cancellation signals are then transmitted to the ears of the listener via the speakers 105. Additionally or alternatively, the processing unit 310 processes sound data acquired via the microphone 322 and generates one or more enhanced signals in order to emphasize or augment certain sounds in the environment of the listener. The enhanced signals are then transmitted to the ears of the listener via to speakers 105. In some embodiments, the processing unit 310 executes an application 332 that generates a user interface (UI) which enables a listener to specify which noises and sounds should be cancelled and/or enhanced by the audio system.

In some embodiments, the head-mounted speaker system 100 may include an open speaker enclosure such that the listener hears direct sound from speakers 105 as well as sounds from the environment, such as sound waves transmitted by highly directional speakers 110 that reflect off of one or more surfaces within the environment. In some embodiments, the head-mounted speaker system 100 may include a closed speaker enclosure such that the listener primarily hears direct sound from speakers 105 and hears little to no sound from the environment. In these latter embodiments, the processing unit 310 may acquire sound data from the environment via the microphone 322 and transmit the sound data to speakers 105(0) and 105(1) such that the sound is heard by the right ear and the left ear of the listener, respectively.

I/O devices 320 may include input devices, output devices, and devices capable of both receiving input and providing output. For example, and without limitation, I/O devices 320 may include wired and/or wireless communication devices that send data to and/or receive data from the sensor(s) 120, the highly directional speakers 110, and/or various types of audio-video devices (e.g., mobile devices, DSPs, amplifiers, audio-video receivers, and/or the like) to which the head-mounted speaker system 100 may be coupled. Further, in some embodiments, the I/O devices 320 include one or more wired or wireless communication devices that receive sound components (e.g., via a network, such as a local area network and/or the Internet) that are to be reproduced by the highly directional speakers 110.

Memory device 330 may include a memory module or a collection of memory modules. Application 332 within memory device 330 may be executed by processing unit 310 to implement the overall functionality of the computing device 300, and, thus, to coordinate the operation of the head-mounted speaker system 100 as a whole. The database 334 may store digital signal processing algorithms, sound components, object recognition data, position data, orientation data, reflectivity data, and/or the like.

Computing device 300 as a whole may be a microprocessor, a system-on-a-chip (SoC), a mobile computing device such as a tablet computer or cell phone, a media player, and/or the like. In some embodiments, the computing device 300 may be coupled to, but separate from the head-mounted speaker system 100. In such embodiments, the head-mounted speaker system 100 may include a separate processor that receives data (e.g., sound components) from and transmits data (e.g., sensor data) to the computing device 300, which may be included in a consumer electronic device, such as a smartphone, portable media player, personal computer, vehicle head unit, navigation system, and/or the like. For example, and without limitation, the computing device 300 may communicate with an external device that provides additional processing power. However, the embodiments disclosed herein contemplate any technically feasible system configured to implement the functionality of the head-mounted speaker system 100.

Figure 4A:
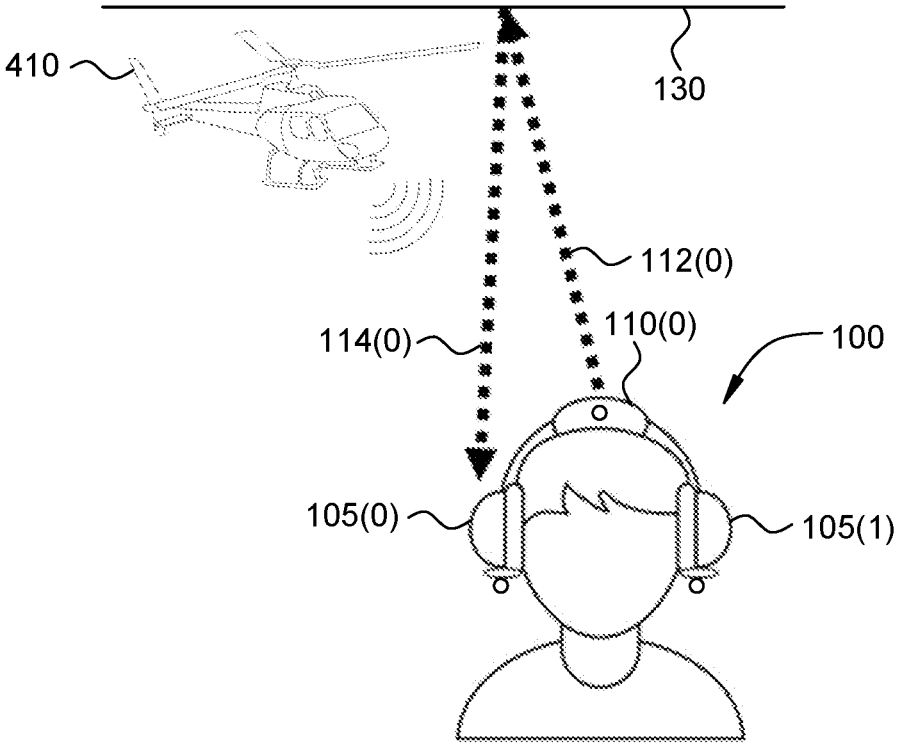
FIGS. 4A and 4B illustrate a listener listening to audio sound fields via the head-mounted speaker system of FIG. 1 within a listening environment, according to various embodiments.
Figure 4B:
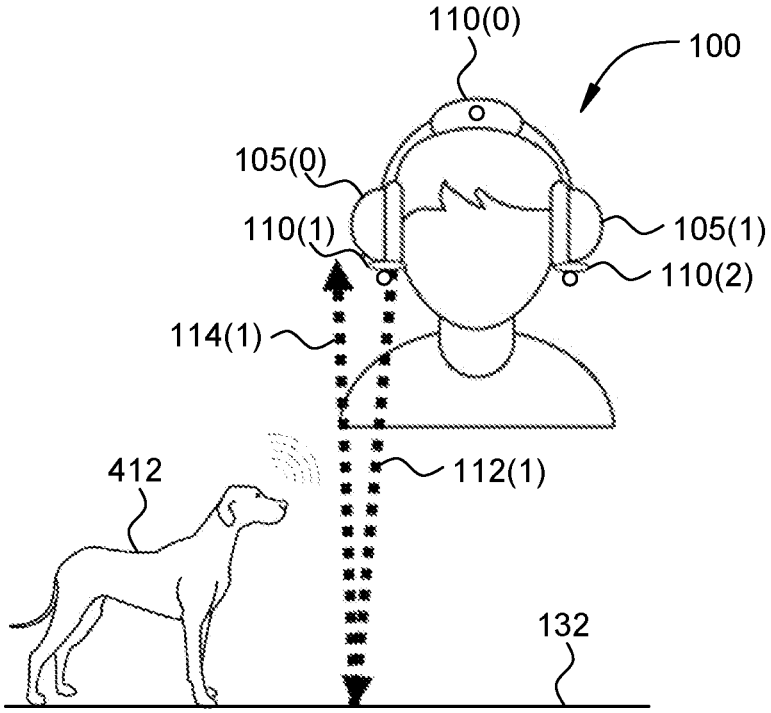

FIGS. 4A and 4B illustrate a listener listening to audio sound fields via the head-mounted speaker system of FIG. 1 within a listening environment, according to various embodiments. As shown in FIG. 4A, a listener wears a head-mounted speaker system 100 that includes at least speakers 105(0) and 105(1) and highly directional speaker 110(0). The head-mounted speaker system 100 receives an audio input signal that includes a sound component representing a helicopter 410 located above and to the right of the listener. The processing unit 310 executes the application 332 to extract the sound component from the audio input signal. The processing unit 310 transmits the audio input signal, including the extracted sound component, to speakers 105(0) and 105(1). In some embodiments, the processing unit 310 may remove or process the sound component from the audio input signal, in whole or in part, prior to transmitting the audio input signal to speakers 105(0) and 105(1).

The processing unit 310 transmits the sound component to highly directional speaker 110(0). Highly directional speaker 110(0) directs sound waves 112(0) representing the sound component towards a particular location on the surface 130 above the listener. The sound waves 112(0) reflect off of the surface 130 and are directed back as sound waves 114(0) towards the listener. As a result, the listener perceives the sound of the helicopter 410 as coming from above and to the right of the listener.

As shown in FIG. 4B, a listener wears a head-mounted speaker system 100 that includes at least speakers 105(0) and 105(1) and highly directional speakers 110(0), 110(1), and 110(2). The head-mounted speaker system 100 receives an audio input signal that includes a sound component representing a dog 412 located below and to the right of the listener. The processing unit 310 executes the application 332 to extract the sound component from the audio input signal. The processing unit 310 transmits the audio input signal, including the extracted sound component, to speakers 105(0) and 105(1). In some embodiments, the processing unit 310 may remove or process the sound component from the audio input signal, in whole or in part, prior to transmitting the audio input signal to speakers 105(0) and 105(1). The processing unit 310 transmits the sound component to highly directional speaker 110(1). Highly directional speaker 110(1) directs sound waves 112(1) representing the sound component towards a particular location on the surface 132 below the listener. The sound waves 112(1) reflect off of the surface 132 and are directed back as sound waves 114(1) towards the listener. As a result, the listener perceives the sound of the dog 412 as coming from below and to the right of the listener.

Figure 5:
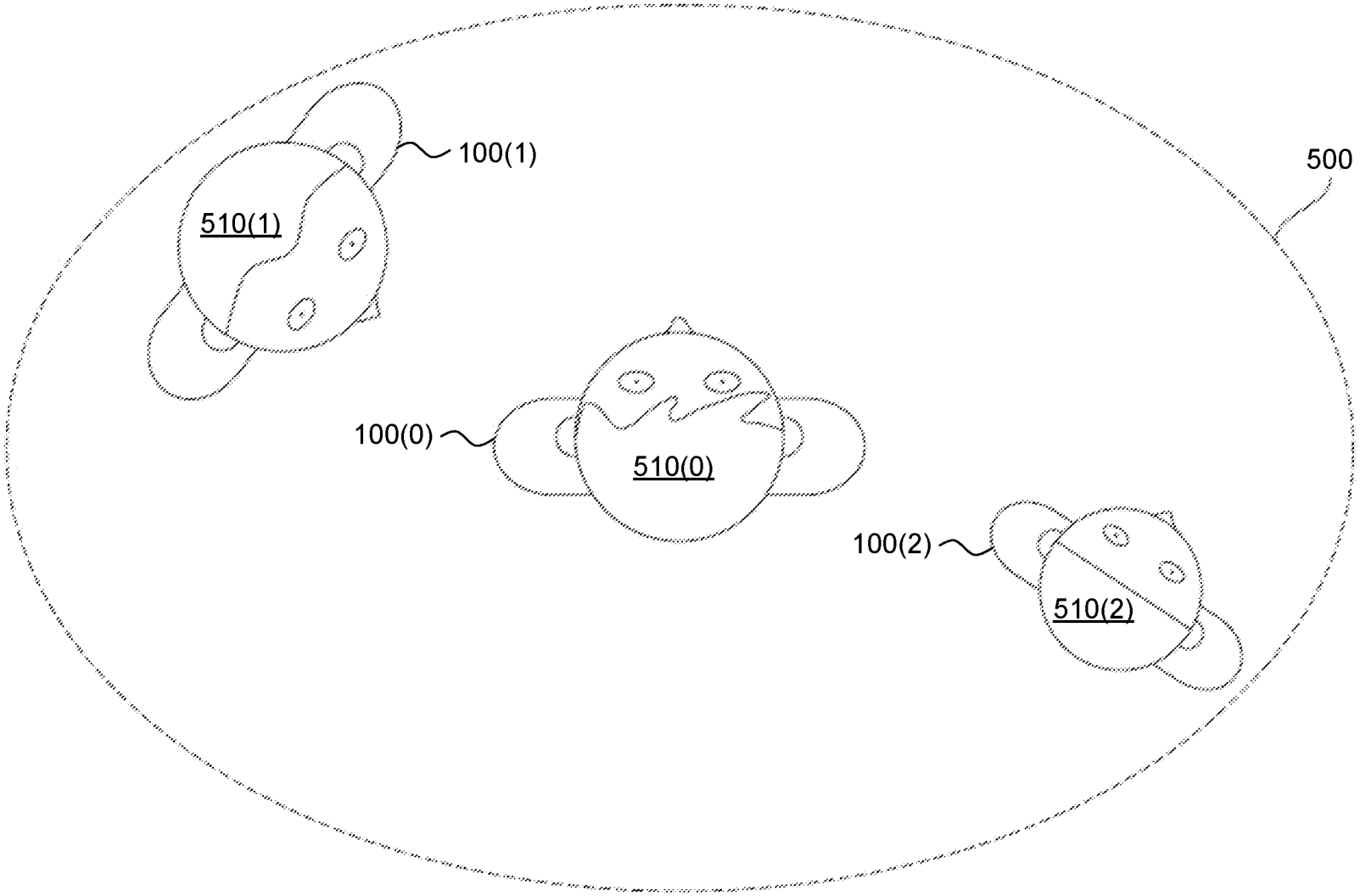
FIG. 5 illustrates the head-mounted speaker system of FIG. 1 in a multi-listener environment, according to various embodiments.

FIG. 5 illustrates the head-mounted speaker system of FIG. 1 in a multi-listener environment, according to various embodiments. As shown, listeners 510(0), 510(1), and 510(2) are in the same environment 500. Each of the listeners 510(0), 510(1), and 510(2) is wearing a head-mounted speaker system 100(0), 100(1), and 100(2), respectively. In some embodiments, the environment 500 is a physical environment, and the head-mounted speaker systems 100(0), 100(1), and 100(2) are audio headphones. In some embodiments, the environment 500 is an AR or a VR environment, and the head-mounted speaker systems 100(0), 100(1), and 100(2) are AR/VR headsets that present audio and video information to listeners 510(0), 510(1), and 510(2), respectively. If head-mounted speaker system 100(0) receives an audio input signal that includes a sound component that is above or below listener 510(0), then head-mounted speaker system 100(0) transmits the sound component to one or more upward facing or downward facing highly directional speakers 110 associated with head-mounted speaker system 100(0). The highly directional speakers 110 transmit sound waves 112 representing the sound component. The sound waves 112 reflect off of surfaces in the environment 500 and are reflected back as sound waves 114 towards the listener 510(0). Because the reflected sound waves 114 are in the environment shared by listeners 510(1) and 510(2), listeners 510(1) and 510(2) may also hear the sound waves 114 representing a sound component received by mounted speaker system 100(0). Similarly, sound waves 112 transmitted by upward facing or downward facing highly directional speakers 110 associated with head-mounted speaker systems 100(1) and 100(2) reflect off of surfaces in the environment 500 are reflected back as sound waves 114 towards any one or more of listeners 510(0), 510(1), and 510(2).

In one example, the processing unit 310 included in head-mounted speaker system 100(0) may determine that the audio input signal includes a sound component that is above or below listener 510(0). The processing unit 310 included in head-mounted speaker system 100(0) may further determine that a highly directional speaker 110 included in one or both of head-mounted speaker systems 100(1) and 100(2) is in a better position and/or orientation to transmit sound waves 112 representing the sound component for listener 510(0). As a result, the processing unit 310 included in head-mounted speaker system 100(0) may transmit the sound component to one or both of head-mounted speaker systems 100(1) and 100(2). The processing unit 310 in one or both of head-mounted speaker systems 100(1) and 100(2) transmits the sound component to at least one highly directional speaker 110 included in the respective head-mounted speaker system 100(1) and/or 100(2). The highly directional speaker(s) 110 transmit sound waves 112 representing the sound component to a location on a surface in the environment. The sound waves 112 reflect off of or more surfaces to generate reflected sound waves 114 that are perceived by listener 510(0). In some embodiments, a central computing device and/or one or more of head-mounted speaker systems 100(0), 100(1), and 100(2) route various sound components via audio signals transmitted to the head-mounted speaker systems 100(0), 100(1), and 100(2). In this manner, sound components representing various sound objects, such as augmented objects and/or virtual objects, may be more realistic relative to an environment 500 where only one listener 510 is wearing a head-mounted speaker system 100.

Figure 6A:
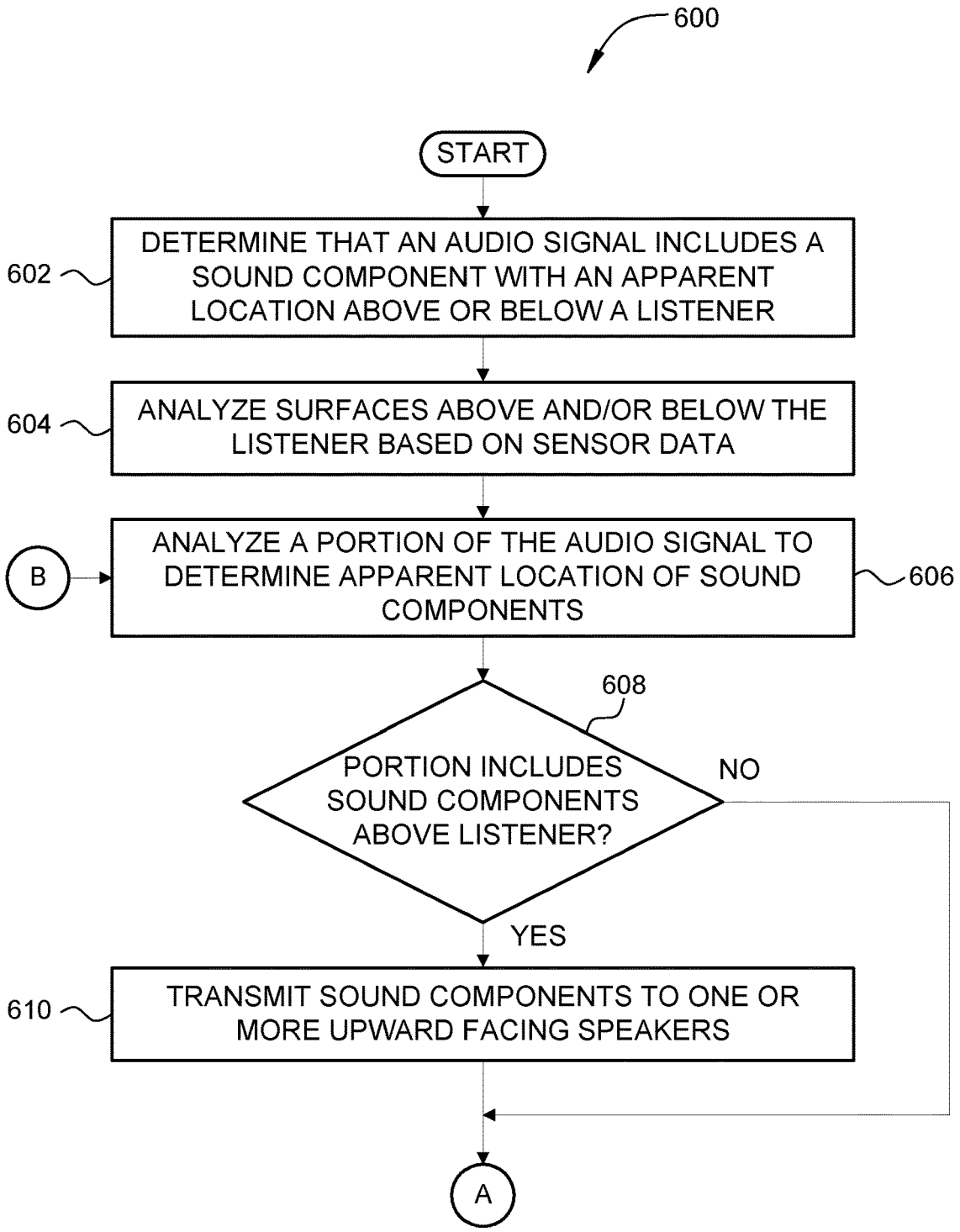
FIGS. 6A-6B set forth a flow diagram of method steps for generating audio for a head-mounted speaker system, according to various embodiments.
Figure 6B:
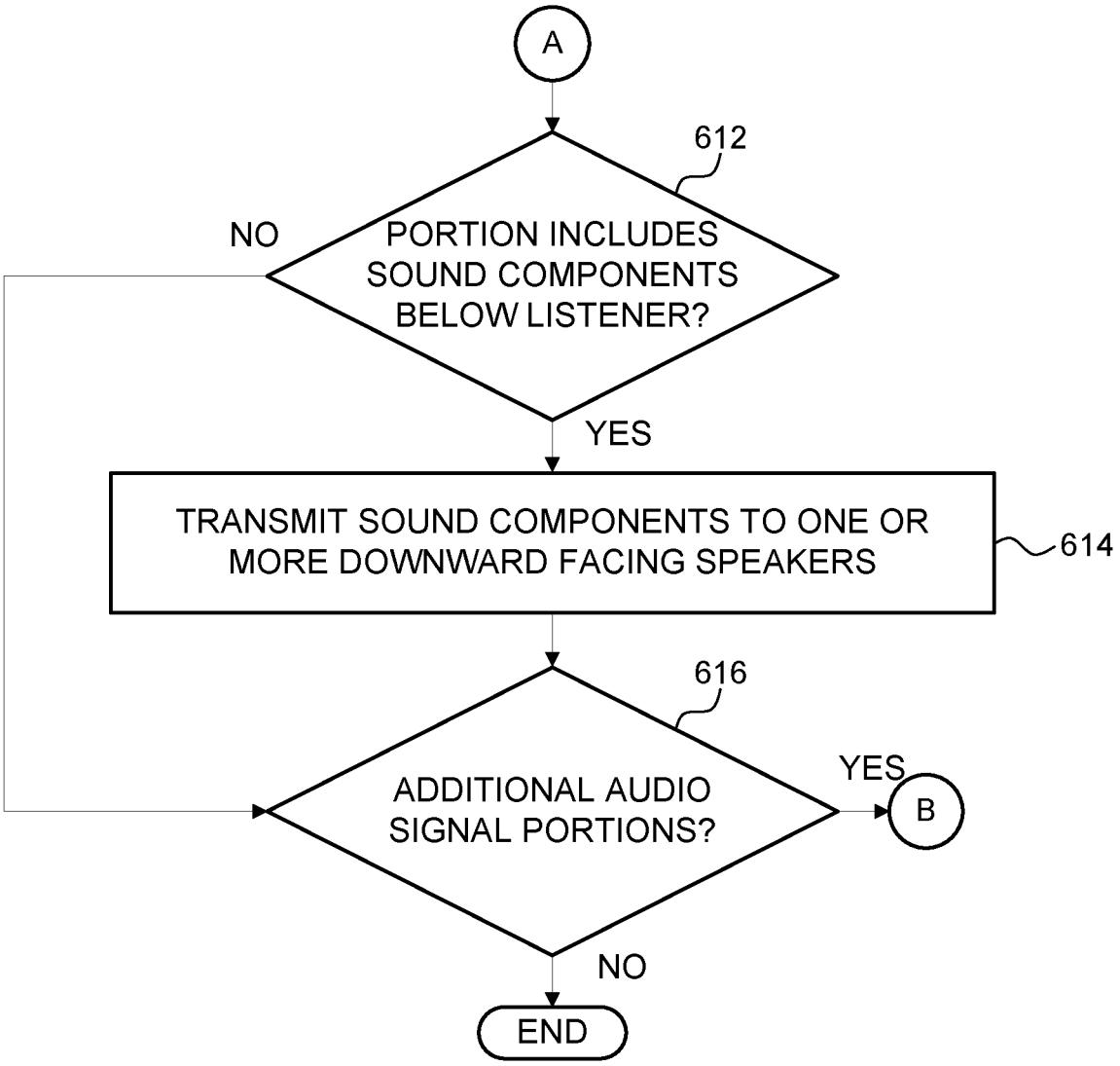

FIGS. 6A-6B set forth a flow diagram of method steps for generating audio for a head-mounted speaker system, according to various embodiments. Although the method steps are described in conjunction with the systems of FIGS. 1-5, persons skilled in the art will understand that any system configured to perform the method steps, in any order, is within the scope of the present disclosure.

As shown, a method 600 begins at step 602, where an application 332 executing on a processing unit 310 included in a head-mounted speaker system 100 determines that an audio input signal includes at least one sound component with an apparent location that is at a vertical distance from the listener, such as above or below the listener. In some embodiments, the head-mounted speaker system 100 receives a stereophonic audio input signal that includes a left audio channel and a right audio channel. In such embodiments, the application 332 analyzes the two channels of the stereophonic audio input signal to determine which portion of the audio input signal is to be extracted as separate sound components and transmitted to one or more highly directional speakers 110. Furthermore, the application 332 determines the positions and/or orientations of one or more locations on surfaces to which sound waves representing the sound components are to be directed.

In some embodiments, the head-mounted speaker system 100 receives a multi-channel audio input signal that includes multiple audio channels, such as a 5.1 audio input signal, a 7.2 audio input signal, and/or the like. In such embodiments, the application 332 analyzes each of the channels of the multi-channel audio input signal to determine which portion of the audio input signal is to be extracted as separate sound components and transmitted to one or more highly directional speakers 110. Furthermore, the application 332 determines the positions and/or orientations of one or more locations on surfaces to which sound waves representing the sound components are to be directed. In this manner, the head-mounted speaker system 100 utilizes the spatial separation of the multiple channels, including the surround channels, to better localize specific sound components.

In some embodiments, the head-mounted speaker system 100 receives an audio input signal that includes separate sound objects, corresponding to sound components located at specific 3D locations in an AR environment and/or a VR environment. The audio input signal includes metadata that specifies the 3D locations of each sound component. For each sound component, the application 332 compares the 3D location of the sound component with the current location of the listener. If any one or more of the sound objects is located above or below the listener, then the application 332 determines the positions and/or orientations of one or more locations on surfaces to which sound waves representing the sound components of the sound objects are to be directed. In this manner, the head-mounted speaker system 100 utilizes the actual locations of AR and/or VR sound objects to better localize specific sound components.

At step 604, the application 332 analyzes surfaces above and/or below the listener based on sensor data received from sensors. The sensors may track the location of the surfaces of surfaces by performing SLAM (simultaneous localization and mapping). The sensors transmit the positions and/or orientations of the surfaces to the application 332. The sensors further transmit the audio reflectivity of various locations on the surfaces to the application 332. Hard surfaces, such as stone, concrete, or metal may have a high reflectivity, indicating that a relatively large portion of the audio is reflected off the surface. Soft surfaces, such as carpet, drapes, or grass may have a low reflectivity, indicating that a relatively large portion of the audio is absorbed by the surface, while a relatively small portion of the audio is reflected off the surface.

The sensors may implement any sensing technique that is capable of tracking the surfaces within the environment. In some embodiments, the sensors include a visual sensor, such as a camera (e.g., a stereoscopic camera). In such embodiments, the sensors may be further configured to perform object recognition in order to determine the position and/or orientation of surfaces. Additionally or alternatively, the sensors may include ultrasonic sensors, radar sensors, laser sensors, LIDAR sensors, thermal sensors, and/or depth sensors, such as TOF sensors, structured light sensors, and/or the like.

At step 606, the application 332 analyzes a portion of the audio input signal to determine the apparent location of sound components included in the portion of the audio input signal. If the audio input signal is a stereophonic audio input signal that includes a left audio channel and a right audio channel, then the application 332 analyzes the two channels of the stereophonic audio input signal. The application 332 determines which portion of the audio input signal is to be extracted as separate sound components and transmitted to one or more highly directional speakers 110. If the audio input signal is a multi-channel audio input signal that includes multiple audio channels, such as a 5.1 audio input signal, a 7.2 audio input signal, and/or the like, then the application 332 analyzes each of the channels of the multi-channel audio input signal. The application 332 determines which portion of the audio input signal is to be extracted as separate sound components and transmitted to one or more highly directional speakers 110. If the audio input signal that includes separate sound objects, corresponding to sound components located at specific 3D locations in an XR environment, then the application 332 analyzes each separate sound objects and associated metadata. If any one or more of the sound objects is located above or below the listener, then the application 332 determines the positions and/or orientations of one or more locations on surfaces to which sound waves representing the sound components of the sound objects are to be directed.

In some embodiments, the application 332 employs object recognition on the audio input signal to detect sound components associated with various objects. The application 332 determines a typical location for the detected sound components. In some embodiments, the application 332 may associate the sound components with a type of object, such as a flying helicopter, a flying airplane, a taxiing airplane, a screeching eagle, a flowing river, an earthquake, and/or the like. The application 332 may use the type of object as a key to find the type of object in a database entry included in the database. The application 332 determines, from the database entry, a location corresponding to the type of object. Based on the location, the application 332 may direct the sound component to one or more upward facing highly directional speakers 110 and/or one or more downward facing highly directional speakers 110.

In one example, the application 332 may determine that the audio input signal includes a sound component representing a flowing river or an earthquake. The application 332 may determine that the location corresponding to a flowing river or an earthquake is below the listener. As a result, the application 332 may direct the sound component to one or more downward facing highly directional speakers 110. In another example, the application 332 may determine that the audio input signal includes a sound component representing a flying helicopter, a flying airplane, or a screeching eagle located at some distance from the listener. The application 332 may determine that the location corresponding to a flying helicopter, a flying airplane, or a screeching eagle is above the listener. As a result, the application 332 may direct the sound component to one or more upward facing highly directional speakers 110. In yet another example, the application 332 may determine that the audio input signal includes a sound component representing an airplane taxiing on a tarmac. The application 332 may determine that the location corresponding to a taxiing airplane is at the level of the listener. As a result, the application 332 may elect to not direct the sound component to any downward facing highly directional speakers 110 or any upward facing highly directional speakers 110.

At step 608, the application 332 determines whether the portion of the audio input signal includes at least one sound component with an apparent location that is above the listener. If the portion of the audio input signal includes at least one sound component with an apparent location that is above the listener, then the method 600 proceeds to step 610, where the application 332 transmits the sound component(s) to one or more upward facing highly directional speakers. The application 332 selects and/or orients one or more upward facing highly directional speakers to particular locations based on the positions, orientations, and/or reflectivity values of various surfaces detected at step 604. The application 332 selects the locations such that the highly directional speakers 110 transmit sound waves towards the locations on a first surface, the sound waves may reflect off of the first surface and optionally off of one or more additional surfaces, and then the sound waves reach the ears of the listener. The upward facing highly directional speakers transmit sound waves representing the sound component(s). The sound waves reflect off of surfaces in the environment and are reflected back as sound waves towards the listener. In some embodiments, the application 332 may delay the audio signal transmitted to speakers 105 to account for the acoustic delays of the sound waves transmitted by the highly directional speakers 110 and reflected off one or more surfaces in the environment. As a result, the timing of the sound waves transmitted by the highly directional speakers 110 and the sound waves transmitted by the speakers 105 are synchronized, as perceived by the listener. The method 600 then proceeds to step 612. If, at step 608, the portion of the audio input signal does not include at least one sound component with an apparent location that is above the listener, then the method 600 proceeds directly to step 612.

At step 612, the application 332 determines whether the portion of the audio input signal includes at least one sound component with an apparent location that is below the listener. If the portion of the audio input signal includes at least one sound component with an apparent location that is below the listener, then the method 600 proceeds to step 614, where the application 332 transmits the sound component(s) to one or more downward facing highly directional speakers. The application 332 selects and/or orients one or more downward facing highly directional speakers to particular locations based on the positions, orientations, and/or reflectivity values of various surfaces detected at step 604. The application 332 selects the locations such that the highly directional speakers 110 transmit sound waves towards the locations on a first surface, the sound waves may reflect off of the first surface and optionally off of one or more additional surfaces, and then the sound waves reach the ears of the listener. The downward facing highly directional speakers transmit sound waves representing the sound component(s). The sound waves reflect off of surfaces in the environment and are reflected back as sound waves towards the listener. In some embodiments, the application 332 may delay the audio signal transmitted to speakers 105 to account for the acoustic delays of the sound waves transmitted by the highly directional speakers 110 and reflected off one or more surfaces in the environment. As a result, the timing of the sound waves transmitted by the highly directional speakers 110 and the sound waves transmitted by the speakers 105 are synchronized, as perceived by the listener. The method 600 then proceeds to step 616. If, at step 612, the portion of the audio input signal does not include at least one sound component with an apparent location that is below the listener, then the method 600 proceeds directly to step 616.

At step 616, the application 332 determines whether the audio input signal includes additional portions that have not yet been processed. If the audio input signal includes additional portions that have not yet been processed, then the method 600 proceeds to step 606, described above. If, on the other hand, the audio input signal does not include additional portions that have not yet been processed, then the method 600 terminates.

In sum, a head-mounted speaker system includes one or more upward facing speakers and/or one or more downward facing speakers. The head-mounted speaker system includes a processing unit that analyzes an audio input signal to determine whether the audio input signal includes sound components that are located above or below the listener. As the processing unit analyzes the audio input signal, if a current portion of the audio input signal includes a sound component located above the speaker, then the processing unit transmits an audio signal associated with the sound component to at least one of the upward facing speakers. Similarly, if a current portion of the audio input signal includes a sound component located below the speaker, then the processing unit transmits an audio signal associated with the sound component to at least one of the downward facing speakers. In some embodiments, the head-mounted speaker system further includes one or more upward facing sensors and/or one or more downward facing sensors. The processing unit employs the upward facing sensors to locate surfaces above the listener and determine the sound reflectivity of these surfaces. The processing unit then directs the sound component towards a particular portion of a surface that has a desired reflectivity. Similarly, the processing unit employs the downward facing sensors to locate surfaces below the listener and determine the sound reflectivity of these surfaces. The processing unit then directs the sound component towards a particular portion of a surface that has a desired reflectivity.

At least one technical advantage of the disclosed techniques relative to the prior art is that sound from the left and right speakers of a head-mounted speaker system is augmented by sound that is reflected off a surface above the listener, giving the listener the impression that the sound is located above the listener. Sound from the left and right speakers of a head-mounted speaker system is further augmented by sound that is reflected off a surface below the listener, giving the listener the impression that the sound is located below the listener. As a result, the head-mounted speaker system generates a more immersive sound field relative to prior approaches. These technical advantages represent one or more technological improvements over prior art approaches.

1. Various embodiments include a computer-implemented method for generating audio for a speaker system worn by a listener, the method comprising: analyzing an audio input signal to determine that a first sound component of the audio input signal has an apparent location that is at a vertical distance from a listener; selecting an externally facing speaker included in the speaker system that faces at least partially upward or at least partially downward based on the vertical distance from the listener; and transmitting the first sound component to the externally facing speaker.

2. The computer-implemented method of clause 1, wherein the apparent location is above the listener, the externally facing speaker is an upward facing speaker, and further comprising: determining a location on a surface that is located above the listener based on the apparent location; and configuring the externally facing speaker to direct sound waves towards the location on the surface.

3. The computer-implemented method of clause 1 or clause 2, wherein the apparent location is below the listener, the externally facing speaker is a downward facing speaker, and further comprising: determining a location on a surface that is located below the listener based on the apparent location; and configuring the externally facing speaker to direct sound waves towards the location on the surface.

4. The computer-implemented method of any of clauses 1-3, further comprising: determining a first reflectivity of a first surface associated with the apparent location; determining a second reflectivity of a second surface associated with the apparent location; and configuring the externally facing speaker to direct sound waves towards a location on the first surface based on the first reflectivity and the second reflectivity.

5. The computer-implemented method of any of clauses 1-4, further comprising steering sound waves transmitted by the externally facing speaker in a first directions based on at least one of via beam-forming techniques or constructive/destructive interference techniques.

6. The computer-implemented method of any of clauses 1-5, wherein the audio input signal comprises a plurality of audio channels, and further comprising: determining that a first audio channel included in the plurality of audio channels includes the first sound component; and extracting the first sound component from the first audio channel.

7. The computer-implemented method of any of clauses 1-6, wherein the audio input signal comprises a plurality of sound components, including the first sound component, and wherein determining that the first sound component of the audio input signal has an apparent location that is at a vertical distance from a listener comprises: determining a location of the first sound component based on metadata included in the audio input signal; comparing the location of the first sound component with a location of the listener; and in response, determining that the first sound component is above or below the listener.

8. Various embodiments include one or more non-transitory computer-readable media storing program instructions that, when executed by one or more processors, cause the one or more processors to perform steps of: analyzing an audio input signal to determine that a first sound component of the audio input signal has an apparent location that is at a vertical distance from a listener; selecting an externally facing speaker included in a first speaker system that faces at least partially upward or at least partially downward based on the vertical distance from the listener; and transmitting the first sound component to the externally facing speaker.

9. The one or more non-transitory computer-readable media of clause 8, wherein the apparent location is above the listener, the externally facing speaker is an upward facing speaker, and further comprising: determining a location on a surface that is located above the listener based on the apparent location; and configuring the externally facing speaker to direct sound waves towards the location on the surface.

10. The one or more non-transitory computer-readable media of clause 8 or clause 9, wherein the apparent location is below the listener, the externally facing speaker is a downward facing speaker, and further comprising: determining a location on a surface that is located below the listener based on the apparent location; and configuring the externally facing speaker to direct sound waves towards the location on the surface.

11. The one or more non-transitory computer-readable media of any of clauses 8-10, further comprising: determining an acoustic delay between a first time when the externally facing speaker transmits a sound wave and a second time when the sound wave reaches an ear of the listener after reflecting off of at least one surface; and delaying transmission of at least a portion of the audio input signal to a speaker located near the ear of the listener based on the acoustic delay.

12. The one or more non-transitory computer-readable media of any of clauses 8-11, wherein: the externally facing speaker transmits sound waves representing the first sound component towards a first location on a first surface; the sound waves, after reflecting off of the first surface, reflect off of one or more additional surfaces; and the sound waves, after reflecting off of the one or more additional surfaces, are directed towards the listener.

13. The one or more non-transitory computer-readable media of any of clauses 8-12, further comprising: analyzing the audio input signal to determine that a second sound component of the audio input signal has an apparent location that is at a second vertical distance from the listener; and transmitting the second sound component to a second speaker system associated with a second listener, wherein the second speaker system:

selects a second externally facing speaker included in the second speaker system that faces at least partially upward or at least partially downward based on the second vertical distance from the listener; and transmits the second sound component to the second externally facing speaker.

14. Various embodiments include a system, comprising: one or more memories storing instructions; and one or more processors coupled to the one or more memories and, when executing the instructions: analyzes an audio input signal to determine that a first sound component of the audio input signal has an apparent location that is at a vertical distance from a listener; selects an externally facing speaker included in a speaker system that faces at least partially upward or at least partially downward based on the vertical distance from the listener; and transmits the first sound component to the externally facing speaker.

15. The system of clause 14, wherein the apparent location is above the listener, the externally facing speaker is an upward facing speaker, and further comprising: determining a location on a surface that is located above the listener based on the apparent location; and configuring the externally facing speaker to direct sound waves towards the location on the surface.

16. The system of clause 14 or clause 15, wherein the apparent location is below the listener, the externally facing speaker is a downward facing speaker, and further comprising: determining a location on a surface that is located below the listener based on the apparent location; and configuring the externally facing speaker to direct sound waves towards the location on the surface.

17. The system of any of clauses 14-16, wherein the externally facing speaker is mounted on a headband included in the speaker system.

18. The system of any of clauses 14-17, wherein the externally facing speaker is mounted on an earcup included in the speaker system.

19. The system of any of clauses 14-18, wherein the externally facing speaker comprises an array of drivers, and each driver included in the array of drivers has a different static orientation.

20. The system of any of clauses 14-19, wherein the externally facing speaker comprises an array of drivers, and a first driver included in the array of drivers is configured to orient the first driver to direct sound waves towards a location on a surface.

Any and all combinations of any of the claim elements recited in any of the claims and/or any elements described in this application, in any fashion, fall within the contemplated scope of the present disclosure and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method, or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable The flowchart and block diagrams in the figures illustrate the architecture, functionality, and operation of possible implementations of systems, methods, and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A computer-implemented method for generating audio for a speaker system worn by a listener, the method comprising:

analyzing an audio input signal to determine that a first sound component of the audio input signal has an apparent location that is at a vertical distance from a listener;

determining, based on the vertical distance from the listener, whether to select an externally facing speaker that faces at least partially upward or an externally facing speaker that faces at least partially downward;

selecting, based on determining whether to select an externally facing speaker that faces at least partially upward or an externally facing speaker that faces at least partially downward, an externally facing speaker included in the speaker system that faces at least partially upward or at least partially downward; and transmitting the first sound component to the externally facing speaker.

2. The computer-implemented method of claim 1, wherein the apparent location is above the listener, the externally facing speaker is an upward facing speaker, and further comprising:

determining a location on a surface that is located above the listener based on the apparent location; and configuring the externally facing speaker to direct sound waves towards the location on the surface.

3. The computer-implemented method of claim 1, wherein the apparent location is below the listener, the externally facing speaker is a downward facing speaker, and further comprising:

determining a location on a surface that is located below the listener based on the apparent location; and configuring the externally facing speaker to direct sound waves towards the location on the surface.

4. The computer-implemented method of claim 1, further comprising:

determining a first reflectivity of a first surface associated with the apparent location;

determining a second reflectivity of a second surface associated with the apparent location; and configuring the externally facing speaker to direct sound waves toward a location on the first surface based on the first reflectivity and the second reflectivity.

5. The computer-implemented method of claim 1, further comprising steering sound waves transmitted by the externally facing speaker in a first direction based on at least one of via beam-forming techniques or constructive/destructive interference techniques.

6. The computer-implemented method of claim 1, wherein the audio input signal comprises a plurality of audio channels, and further comprising:

determining that a first audio channel included in the plurality of audio channels includes the first sound component; and extracting the first sound component from the first audio channel.

7. The computer-implemented method of claim 1, wherein the audio input signal comprises a plurality of sound components, including the first sound component, and wherein determining that the first sound component of the audio input signal has the apparent location that is at the vertical distance from the listener comprises:

determining a location of the first sound component based on metadata included in the audio input signal;

comparing the location of the first sound component with a location of the listener; and in response, determining that the first sound component is above or below the listener.

8. One or more non-transitory computer-readable media storing program instructions that, when executed by one or more processors, cause the one or more processors to perform steps of:

analyzing an audio input signal to determine that a first sound component of the audio input signal has an apparent location that is at a vertical distance from a listener;

determining, based on the vertical distance from the listener, whether to select an externally facing speaker that faces at least partially upward or an externally facing speaker that faces at least partially downward;

selecting, based on determining whether to select an externally facing speaker that faces at least partially upward or an externally facing speaker that faces at least partially downward, an externally facing speaker included in a first speaker system that faces at least partially upward or at least partially downward; and transmitting the first sound component to the externally facing speaker.

9. The one or more non-transitory computer-readable media of claim 8, wherein the apparent location is above the listener, the externally facing speaker is an upward facing speaker, and further comprising:

determining a location on a surface that is located above the listener based on the apparent location; and configuring the externally facing speaker to direct sound waves towards the location on the surface.

10. The one or more non-transitory computer-readable media of claim 8, wherein the apparent location is below the listener, the externally facing speaker is a downward facing speaker, and further comprising:

determining a location on a surface that is located below the listener based on the apparent location; and configuring the externally facing speaker to direct sound waves towards the location on the surface.

11. The one or more non-transitory computer-readable media of claim 8, further comprising:

determining an acoustic delay between a first time when the externally facing speaker transmits a sound wave and a second time when the sound wave reaches an ear of the listener after reflecting off of at least one surface; and delaying transmission of at least a portion of the audio input signal to a speaker located near the ear of the listener based on the acoustic delay.

12. The one or more non-transitory computer-readable media of claim 8, wherein:

the externally facing speaker transmits sound waves representing the first sound component towards a first location on a first surface;

the sound waves, after reflecting off of the first surface, reflect off of one or more additional surfaces; and the sound waves, after reflecting off of the one or more additional surfaces, are directed towards the listener.

13. The one or more non-transitory computer-readable media of claim 8, further comprising:

analyzing the audio input signal to determine that a second sound component of the audio input signal has an apparent location that is at a second vertical distance from the listener; and transmitting the second sound component to a second speaker system associated with a second listener, wherein the second speaker system:

selects a second externally facing speaker included in the second speaker system that faces at least partially upward or at least partially downward based on the second vertical distance from the listener; and transmits the second sound component to the second externally facing speaker.

14. A system, comprising:

one or more memories storing instructions; and one or more processors coupled to the one or more memories and, when executing the instructions:

analyzes an audio input signal to determine that a first sound component of the audio input signal has an apparent location that is at a vertical distance from a listener;

determines, based on the vertical distance from the listener, whether to select an externally facing speaker that faces at least partially upward or an externally facing speaker that faces at least partially downward;

selects, based on determining whether to select an externally facing speaker that faces at least partially upward or an externally facing speaker that faces at least partially downward, an externally facing speaker included in a speaker system that faces at least partially upward or at least partially downward; and transmits the first sound component to the externally facing speaker.

15. The system of claim 14, wherein the apparent location is above the listener, the externally facing speaker is an upward facing speaker, and further comprising:

determining a location on a surface that is located above the listener based on the apparent location; and configuring the externally facing speaker to direct sound waves towards the location on the surface.

16. The system of claim 14, wherein the apparent location is below the listener, the externally facing speaker is a downward facing speaker, and further comprising:

determining a location on a surface that is located below the listener based on the apparent location; and configuring the externally facing speaker to direct sound waves towards the location on the surface.

17. The system of claim 14, wherein the externally facing speaker is mounted on a headband included in the speaker system.

18. The system of claim 14, wherein the externally facing speaker is mounted on an earcup included in the speaker system.

19. The system of claim 14, wherein the externally facing speaker comprises an array of drivers, and each driver included in the array of drivers has a different static orientation.

20. The system of claim 14, wherein the externally facing speaker comprises an array of drivers, and a first driver included in the array of drivers is configured to orient the externally facing speaker to direct sound waves towards a location on a surface.

* * * * *